US009955803B2

(12) United States Patent
Twohy

(10) Patent No.: US 9,955,803 B2
(45) Date of Patent: May 1, 2018

(54) DOOR FOR A REFRIGERATED MERCHANDISER

(71) Applicant: Hussmann Corporation, Bridgeton, MO (US)

(72) Inventor: Raymond P. Twohy, Saint Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 537 days.

(21) Appl. No.: 14/570,723

(22) Filed: Dec. 15, 2014

(65) Prior Publication Data

US 2016/0166085 A1 Jun. 16, 2016

(51) Int. Cl.

| | |
|---|---|
| ***H05B 3/00*** | (2006.01) |
| ***A47F 3/04*** | (2006.01) |
| ***A47F 3/00*** | (2006.01) |
| ***A47F 3/12*** | (2006.01) |

(52) U.S. Cl.

CPC ..... *A47F 3/043* (2013.01); *A47F 3/001* (2013.01); *A47F 3/0434* (2013.01); *A47F 3/125* (2013.01); *A47B 2220/0072* (2013.01)

(58) Field of Classification Search

CPC ..... A47F 3/0434; A47F 3/0439; A47F 3/043; A47F 3/001; A47F 3/125; E06B 3/66304; E06B 3/66309; H05B 3/84; Y02B 80/24

See application file for complete search history.

(56) References Cited

U.S. PATENT DOCUMENTS

| | | | | |
|---|---|---|---|---|
| 4,878,850 | A | 11/1989 | Letemps et al. | |
| 5,941,619 | A | 8/1999 | Stieben et al. | |
| 6,051,820 | A * | 4/2000 | Poix | A47F 3/0434 219/202 |

(Continued)

FOREIGN PATENT DOCUMENTS

| | | |
|---|---|---|
| CA | 944805 | 4/1974 |
| CA | 1263971 | 12/1989 |

(Continued)

OTHER PUBLICATIONS

Examination report from the Canadian Intellectual Property Office for Application No. 2,912,448 dated Sep. 30, 2016 (4 pages).

(Continued)

*Primary Examiner* — Shawntina Fuqua

(74) *Attorney, Agent, or Firm* — Michael Best & Friedrich LLP

(57) ABSTRACT

A door for a refrigerated merchandiser including a case defining a product display area. The door includes a door frame that is attachable to the case, and a glass panel assembly that is coupled to the door frame. The glass panel assembly includes a first glass panel and a second glass panel that is spaced apart from the first glass panel by a gap. The glass panel assembly further includes a conductive coating that is applied to the first glass panel, and a heater element that is coupled to the first glass panel and that is in electrical communication with the conductive coating. The door also includes a connector that extends through the first glass panel and the second glass panel and securable to the glass panel assembly, and the connector is configured to electrically connect the heater element to a power source.

19 Claims, 6 Drawing Sheets

(56) References Cited

U.S. PATENT DOCUMENTS

| | | | | |
|---|---|---|---|---|
| 6,488,796 | B2 | 12/2002 | Poix et al. | |
| 8,215,007 | B2 | 7/2012 | Gerhardinger et al. | |
| 8,461,495 | B2 | 6/2013 | Gerhardinger | |
| 2001/0026852 | A1 | 10/2001 | Poix et al. | |
| 2005/0269312 | A1 | 12/2005 | Gerhardinger | |
| 2008/0141689 | A1 | 6/2008 | Sunderland et al. | |
| 2013/0239484 | A1* | 9/2013 | Chubb ..... | E06B 7/16 49/70 |

FOREIGN PATENT DOCUMENTS

| | | |
|---|---|---|
| CA | 2276591 | 7/1998 |
| CA | 2281675 | 8/1998 |
| CA | 2282828 | 9/1999 |
| CA | 2345116 | 4/2000 |
| CA | 2349485 | 5/2000 |
| CA | 2411503 | 12/2001 |
| CA | 2454180 | 1/2003 |
| CA | 2234281 | 10/2006 |
| CA | 2643876 | 5/2009 |
| CN | 2518987 | 10/2002 |
| EP | 0870450 | 10/1998 |
| FR | 2769337 | 4/1999 |
| WO | 2010021788 | 2/2010 |

OTHER PUBLICATIONS

Patent Examination Report No. 1 from IP Australia for Application No. 2015249169 dated Apr. 6, 2016 (7 pages).

Extended European Search Report for Application No. 15192144.2 dated May 17, 2016 (7 pages).

* cited by examiner

DOOR FOR A REFRIGERATED MERCHANDISER

BACKGROUND

The present invention relates to doors for refrigerated merchandisers and, more particularly, to a doors that includes a connector assembly that couples a power source to a heater element applied to the door.

Refrigerated merchandisers generally include a case defining a product display area for supporting and displaying food products to be visible and accessible through an opening in the front of the case. Refrigerated merchandisers are generally used in retail food store applications such as grocery or convenient stores or other locations where food product is displayed in a refrigerated condition. Some refrigerated merchandisers include doors to enclose the product display area of the case and reduce the amount of cold air released into the surrounding environment. The doors typically include a glass panel, allowing a consumer to view the food products stored inside the case.

Refrigerated merchandisers may be susceptible to condensation forming on the glass panel of the door, which obstructs viewing of the food product positioned inside the case. Electrical current passed to the glass panel is used to heater the glass thereby preventing condensation from forming thereon.

SUMMARY

The invention provides a door for a refrigerated merchandiser including a case defining a product display area. The door includes a door frame that is attachable to the case, and a glass panel assembly that is coupled to the door frame. The glass panel assembly includes a first glass panel and a second glass panel that is spaced apart from the first glass panel by a gap. The glass panel assembly further includes a conductive coating that is applied to the first glass panel, and a heater element that is coupled to the first glass panel and that is in electrical communication with the conductive coating. The door also includes a connector that extends through the first glass panel and the second glass panel and securable to the glass panel assembly, and the connector is configured to electrically connect the heater element to a power source.

The invention also provides a refrigerated merchandiser door including a door frame that is attachable to the case, and a glass panel assembly that is coupled to the door frame and that includes a first glass panel and a second glass panel spaced apart from the first glass panel by a gap. The glass panel assembly further includes a conductive coating that is applied to the first glass panel, and a heater element that is coupled to the first glass panel and that is in electrical communication with the conductive coating. The door also includes a connector that extends through the first glass panel and securable to the glass panel assembly, and a connector bushing that is coupled to the connector and that is positioned between the connector and the heater element. The connector bushing defines a seal configured to at least partially compress in response to a vacuum applied to the gap to seal the gap.

The invention also provides a refrigerated merchandiser door including a glass panel assembly that has a first glass panel and a second glass panel spaced apart from the first glass panel by a gap. The glass panel assembly further includes a conductive coating that is applied to the first glass panel, and a heater element that is coupled to the first glass panel and that is in electrical communication with the conductive coating. The door also includes a connector that extends through the first glass panel and that is securable to the glass panel assembly to electrically connect the heater element to a power source, and a hinge that is attached to the glass panel assembly by the connector to facilitate movement of the door between an open position and a closed position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
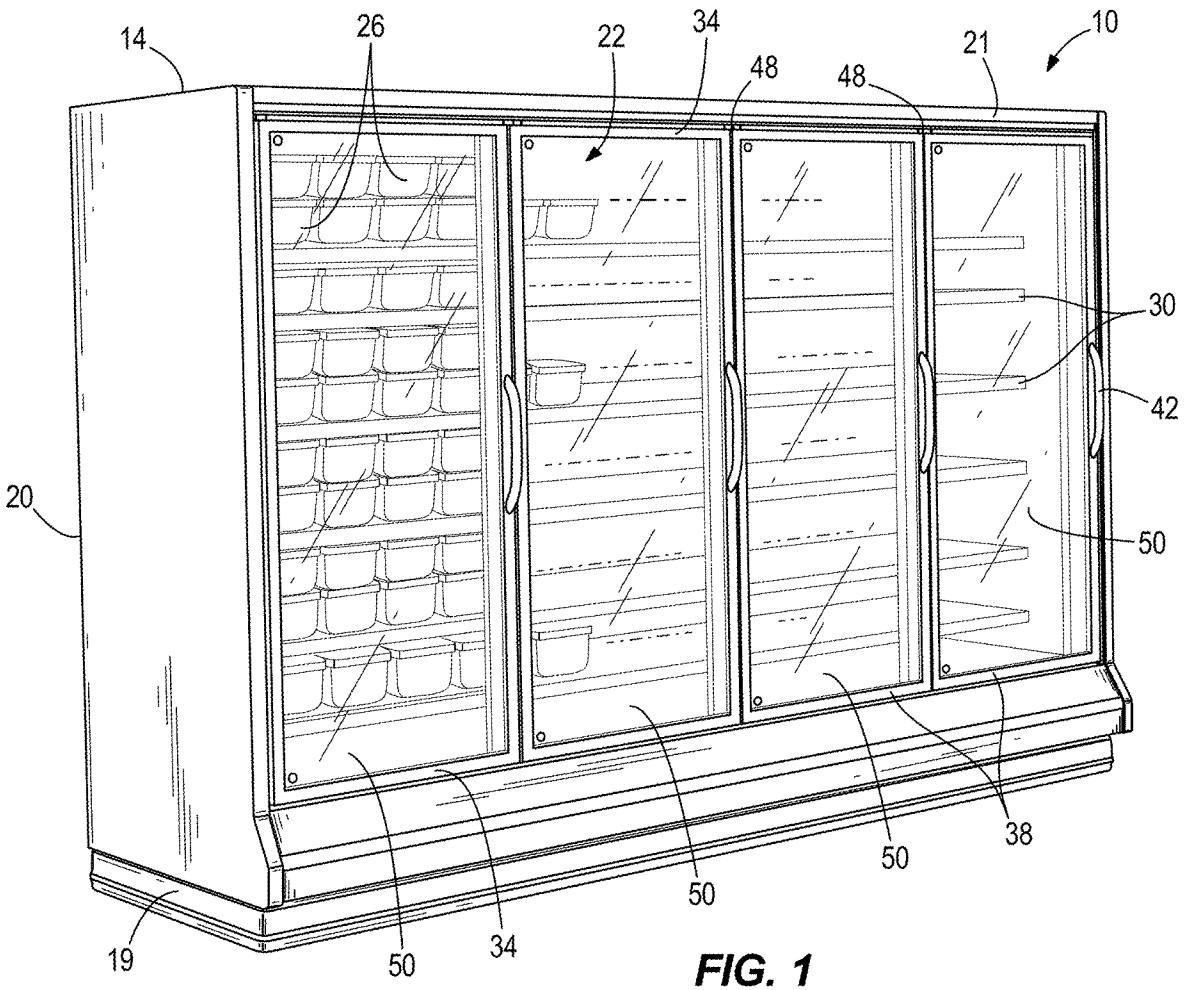
FIG. 1 is a perspective view of a refrigerated merchandiser including doors embodying the invention.

FIG. 1 illustrates one construction of a refrigerated merchandiser 10 that may be located in a supermarket or a convenience store or other retail setting (not shown) for presenting fresh food, beverages, and other food product (not shown) to consumers. The refrigerated merchandiser 10 includes a case 14 that has a base 18, a rear wall 20, and a canopy 21 that cooperatively define a product display area 22 that can support product 26 (e.g., on shelves 30). The product display area 22 is accessible adjacent the front of the case 14 through an access opening that is enclosed by doors 34. Although the refrigerated merchandiser 10 includes four doors 34 providing access to the product display area 22, it will be appreciated that the refrigerated merchandiser 10 may include fewer or more than four doors 34.

The refrigerated merchandiser 10 also includes at least a portion of a refrigeration system (not shown) that provides a refrigerated airflow to the product display area 22 (e.g., via apertures in the rear wall 20, a discharge outlet in the canopy 21, etc.). The refrigeration system generally includes an evaporator that is located within an air passageway internal to the case and that is fluidly connected between a condenser (not shown) and one or more compressors. Such refrigeration system arrangements are well known in the art, and as such, these features will not be described in detail.

Figure 2:
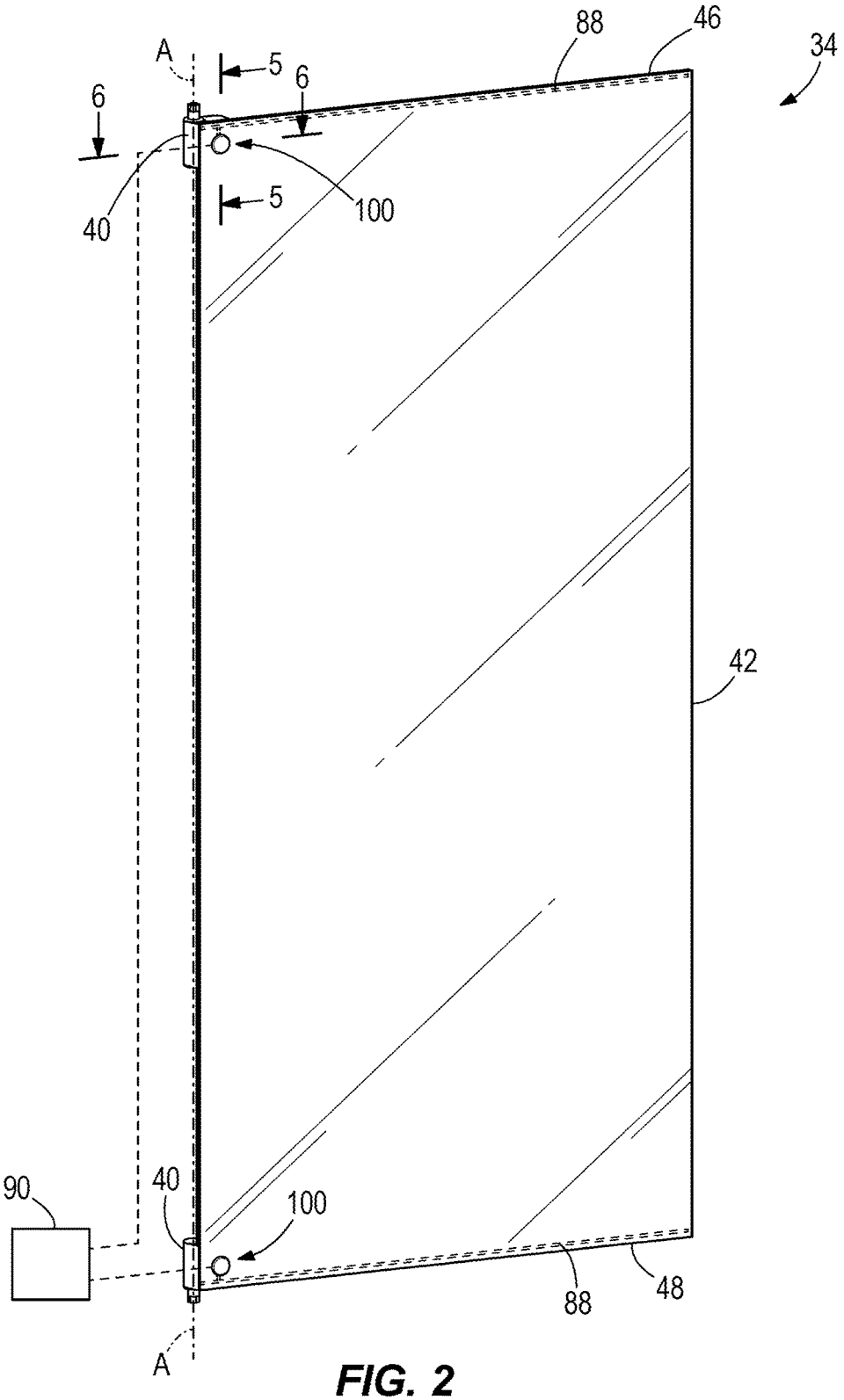
FIG. 2 is a perspective view of one of the doors of the refrigerated merchandiser of FIG. 1, illustrating a hinge assembly and an electrical connector assembly.

With reference to FIGS. 1 and 2, each door 34 has a door frame 38, upper and lower hinge assemblies 40 that attach the door frame 38 to the case 14, a glass panel assembly 42, and a handle 44 that is coupled to the door frame 38 (in some circumstances, the handle 44 can be coupled directly to the glass panel assembly 42). The handle facilitates movement of the door 34 between open and closed positions about a pivot axis A extending through the hinge assemblies 40. As will be appreciated, the door 34 can be mounted to the case 14 in other ways (e.g., slidable within a track, etc.). For example, the door 34 can be mounted such that the hinge assemblies 40 directly attach to the glass panel assembly 42 to facilitate pivotal movement of the door 34.

The hinge assemblies 40 are coupled to the door 34 on one side adjacent top and bottom edges 46, 48 of the door frame 38. FIGS. 2, 3, 5, and 6 show that each hinge assembly 40 includes a hinge body 52 that is attached to an interior side of the glass panel assembly 42, and a hinge pin 56 that is disposed or received in the hinge body 52. The hinge body 52 has a base 58 that is attached to the glass panel assembly 42 and a flange 60 that extends over a portion of the side of the glass panel assembly 42.

The glass panel assembly 42 separates the product display area 22 from the surrounding ambient environment and permits viewing of the product 26 from outside the case 14. The illustrated glass panel assembly 42 has a first glass panel 68 positioned closest to the product display area 22, and a second glass panel 72 that is spaced apart from the first glass panel 68 by a gap 76. The gap 76 is sealed (e.g., by laminated sealing, vacuum sealing etc.) to limit infiltration of debris between the panels 68, 72, and to inhibit or limit heat transfer across or through the glass panels 68, 72 between the product display area 22 and the ambient environment. Although the glass panel assembly 42 is described in detail as having two glass panels 68, 72 (with the second glass panel 72 positioned adjacent the ambient environment), the assembly 40 can include additional glass panels (e.g., positioned between the glass panels 68, 72, positioned further exterior of the glass panel 72 relative to the product display area 22, etc.).

With reference to FIGS. 2, 3, 5, and 6 show that the first glass panel 68 has two first holes 80 (one shown), and the second glass panel 72 has two second holes 84 (one shown). Each first hole 80 (one shown) and each second hole 84 is located adjacent the hinge assemblies 40 and is aligned with a corresponding hole 82 in the bases 58 of the hinge assemblies 40 when the door 34 is assembled. The second holes 84 are further aligned with the first holes 80 upon assembly of the door 34.

Figure 3:
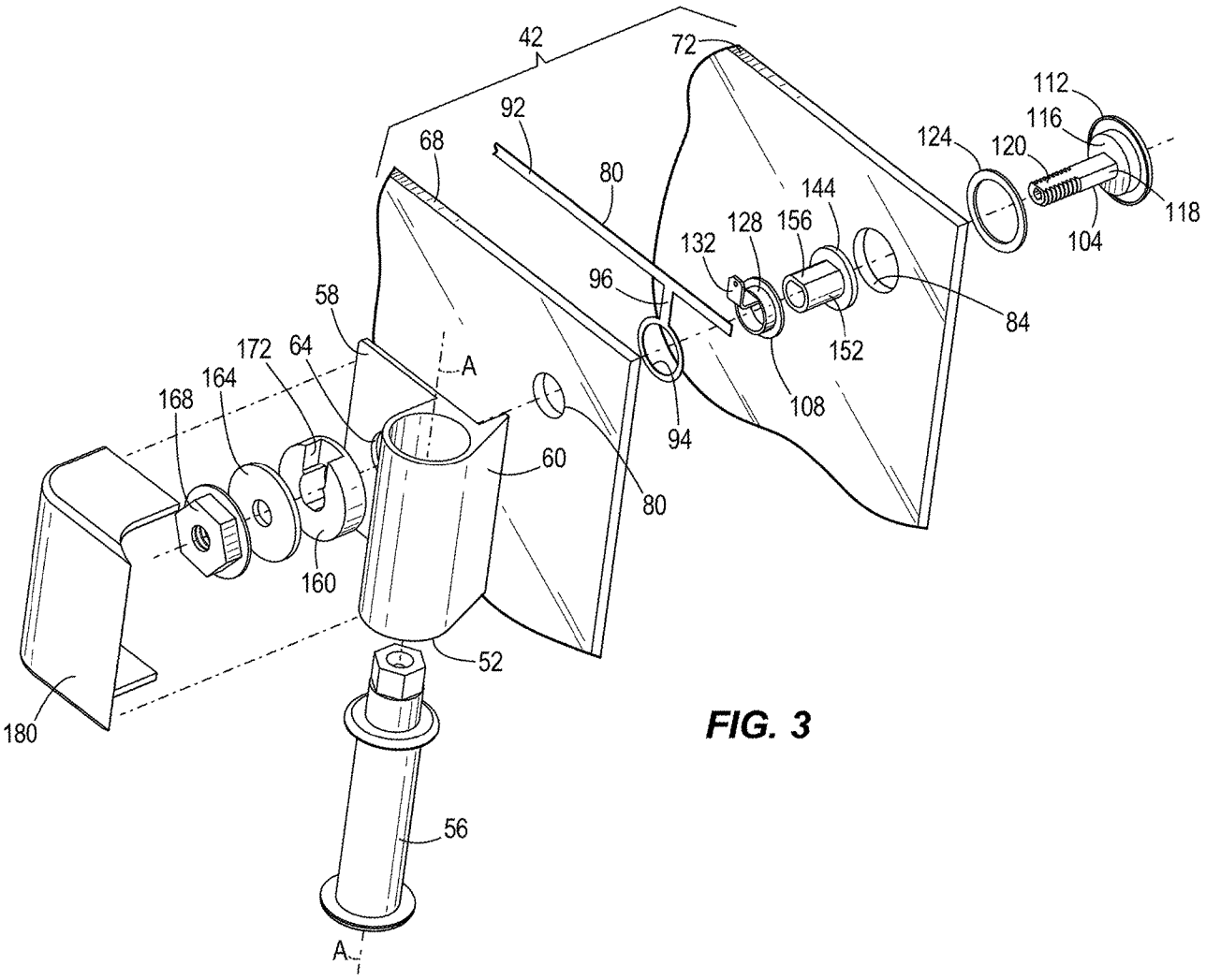
FIG. 3 is an exploded perspective view of a portion of the door of FIG. 2.
Figure 5:
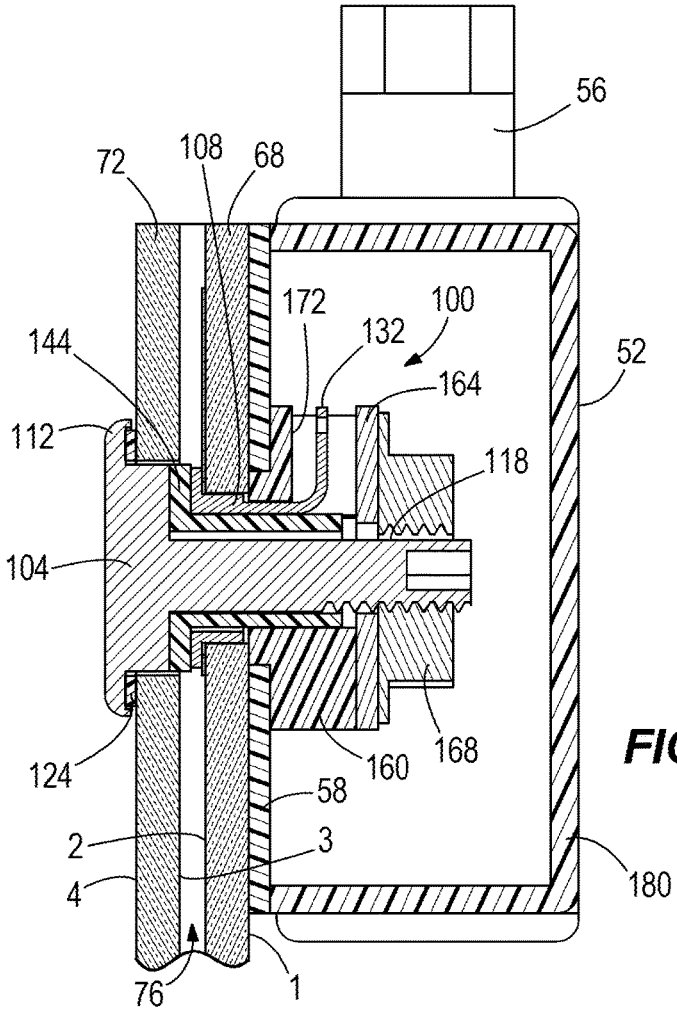
FIG. 5 is a cross-section of the door of FIG. 2 taken along line 5-5.
Figure 6:
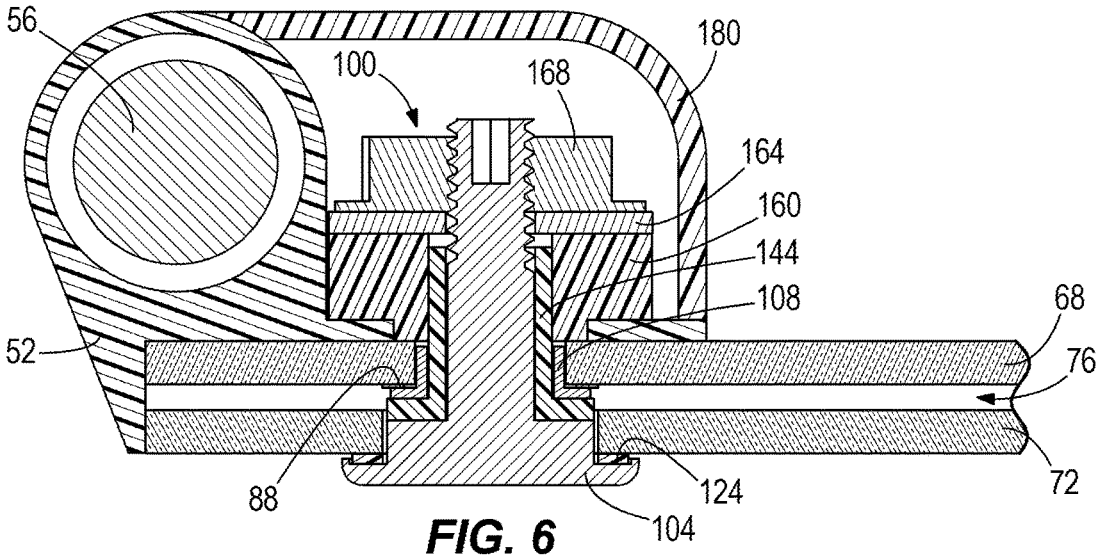
FIG. 6 is a cross-section view of the door of FIG. 2 taken along line 6-6.

The illustrated first glass panel 68 has a transparent resistive or conductive coating that can heat the door 34 to inhibit formation of or remove fog and condensation on the glass panel assembly 42. With reference to FIGS. 3, 5, and 6, the coating is applied to the surface of the panel 68 that faces away from the product display area 22 (i.e. if each of the four surfaces of the glass panels 68, 72 are labeled from 1-4 starting with the surface closest to or adjacent the product display area 22 (see FIGS. 5 and 6), the surface onto which the conductive coating is applied is surface 2). As will be appreciated, the conductive coating can be applied to surface 1 of the first glass panel 68. The coating may be a metallic pyrolytic coating, a magnetic sputter vacuum deposition coating, or another suitable coating that can apply heat to the surface of the first glass panel 68. A protective layer or film can be applied over the coating to protect the coating from direct contact. The second glass panel 72 can have a transparent coating (e.g., a low emissivity coating, a conductive coating, etc.), or the second glass panel 72 can be provided without a coating.

As shown in FIGS. 2 and 3, heater elements 88 are disposed on (e.g., adhered to) the surface 2 of the first glass panel 68 (i.e. on the surface facing away from the product display area 22). The heater elements 88 are in communication with the conductive coating and a power supply or source 90 to electrically connect the coating to the power supply 90 so that heat can be applied to the panel 68. The illustrated heater elements 88 are defined by bus bars that extend along opposite edges of the door 34 and that terminate adjacent the hinge assemblies 40. Referring to FIG. 3, one heater element 88 extends along the top edge 46 of the door 34, and the other heater element 88 extends along the bottom edge 48 of the door 34. It will be appreciated that the heater elements 88 can extend vertically along the left and right edges of the door 34, or that a single heater element 88 can extend along all three or four of the edges of the door 34. Referring to FIG. 3, each heater element 88 is defined by a strip 92 of electrically-conductive material that extends along the corresponding edge 46, 48, a connector segment 94 that extends around one of the first holes 80, and a bridge 96 that extends between and electrically connects the strip 92 and the connector segment 94.

Figure 4:
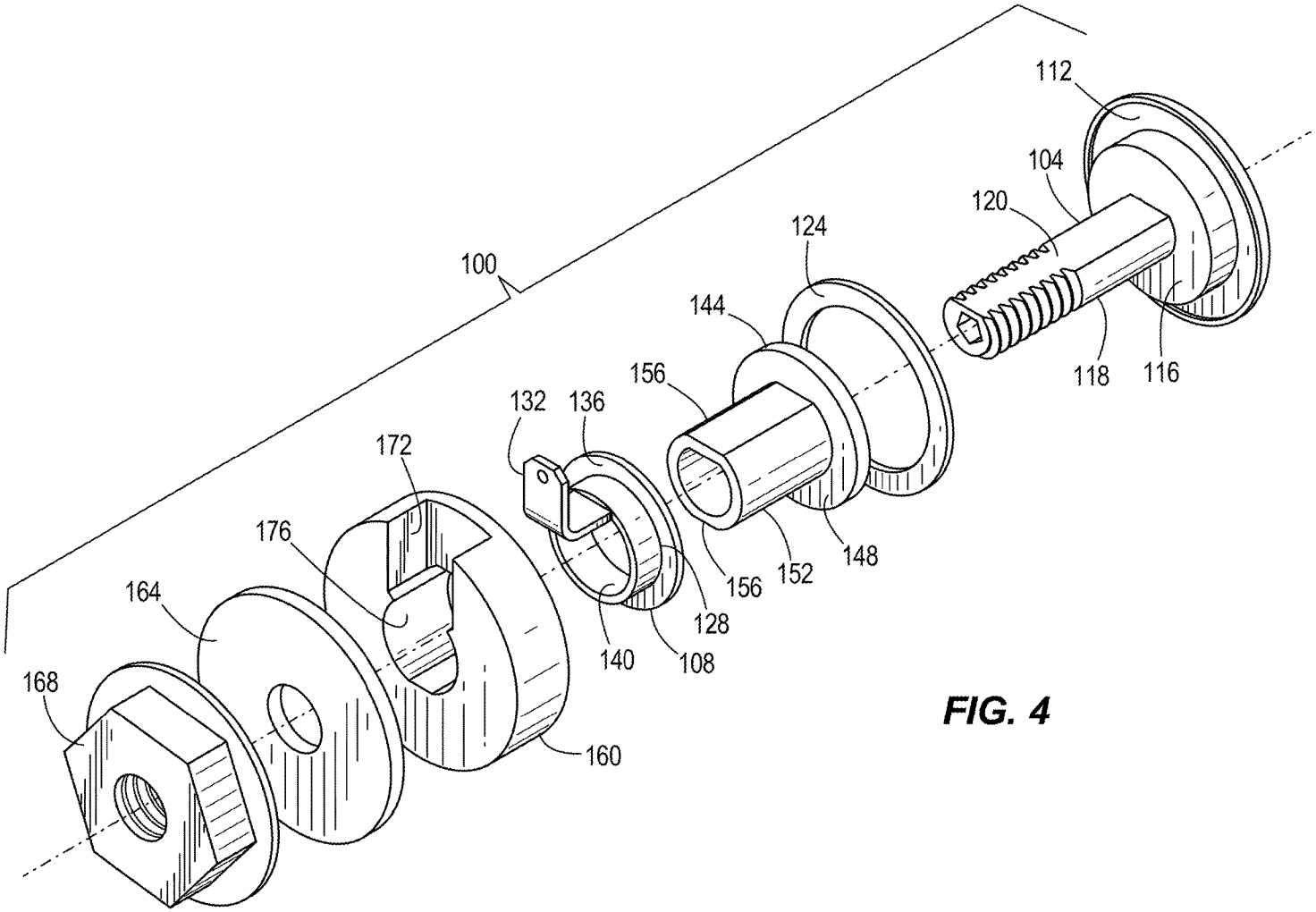
FIG. 4 is an exploded perspective view of the connector assembly of FIG. 2.

FIGS. 2-6 show that the heater elements 88 are electrically connected to the power supply 90 by an electrical connector assembly 100. Referring to FIGS. 3-6, the connector assembly 100 includes a connector 104 and a connector bushing 108 that is coupled to the connector 104. The illustrated connector 104 is a fastener (e.g., a bolt), although the connector 104 can take other forms of connectors (e.g., elongated structure) that can be mechanically tightened and loosened. The connector 104 has a head 112 with a stepped portion 116 that centers the connector 104 in the second hole 84, and a threaded elongated body 118 that extends through the holes 64, 80, 84. As shown in FIG. 4, the elongated body 118 is substantially cylindrical and has a flattened or planar section 120 such that the body 118 120. A gasket 124 (e.g., an O-ring) surrounds the stepped portion 116 to seal the connection between the connector head 112 and the second glass panel 72. The connector 104 can be formed of an electrically-conductive material (e.g., a metal or alloy), an electrically insulative material (e.g., plastic, composite, etc.), or other material.

As illustrated in FIG. 4, the connector bushing 108 has an annular body 128 and a projection or tab 132 that is electrically connected to the power supply 90 (e.g., by wires). The body 128 has a platform 136 and a column 140 that extends outward from the platform 136. The body 128 is coupled to the first glass panel 68 such that the connector segment 94 is sandwiched between the surface 2 of the glass panel 68 and the platform 136, and the column 140 extends through the first hole 80. The tab 132 extends outward from the column 140 and can be straight or bent (as illustrated).

With reference to FIGS. 3-6, the connector bushing 108 is separated from the connector 104 by a first or inner insulation bushing 144. As illustrated, the inner insulation bushing 144 is coupled to (e.g., positioned over) the elongated body 118 to electrically isolate or insulate the connector 104 from the connector bushing 108 so that an electrical current does not pass through the connector 104. Portions of the connector bushing 108 and the inner insulation bushing 144 are positioned in the gap 76 and other portions of each component extend through the first glass panel 68. Referring to FIGS. 4-6, the inner insulation bushing 144 has a head 148 and a column 152 that extends from the head 144. The head 148 is positioned between and sandwiched by stepped portion 116 of the connector 104 and the connector bushing 108. The column 152 extends through the annular body 128 of the connector bushing 108, and has a length that is shorter than the overall length of the elongated body 118. The column 152 has flats 156 (e.g., on top and bottom sides, as illustrated in FIG. 4, although the column 152 may only have one flat 156) that cooperate with the planar section 120 to provide a key between the connector 104 and the inner isolation bushing 144 (e.g., to limit rotation of the connector 104 during installation/assembly).

The electrical connector assembly 100 also includes a second or outer insulation bushing 160, an isolation washer 164, and a nut or cap 168. The outer insulation bushing 160 is coupled to (e.g., positioned over) the connector bushing 108 to electrically isolate or insulate the connector bushing 108.

FIGS. 4-6 show that the outer insulation bushing 160 is defined by an annular body that is partially nested in the base 58 of the hinge body 52. The outer insulation bushing 160 has a pocket 172 that accommodates the tab 132 after assembly and that provides access to the tab 132 from outside the connector assembly 100 so that the power supply 90 can be connected to the connector bushing 108. More specifically, the pocket 172 extends from a central hole 176 in the second insulation bushing 160 and is exposed on the outer periphery of the bushing 160. A portion of the central hole 176 is flattened so that the inner insulation bushing 144 can be keyed with the outer insulation bushing 160.

The outer insulation bushing 160 also has a thickness and the pocket 172 has a depth (axially along axis B) that extends axially from one side of the bushing 160 toward the other side, but as shown in FIGS. 4 and 5, the pocket 172 stops short of axially extending completely through the bushing 160. The tab 132 extends from the column 152 and protrudes into the pocket 132. The isolation washer 164 partially encapsulates the pocket 172 to electrically isolate the tab 132 in the axial direction (i.e. along axis B) so that access to the connector bushing 108 is at least partially obstructed while still providing access to the tab 132 from a side of the bushing 160. The cap 168 is threadably attached to the elongated body 118 to secure the connector assembly 100 onto the glass panel assembly 42 when the cap 168 is tightened.

Assembly of the glass panel assembly 42 and the electrical connector assembly 100 can be done several ways, one of which is described below. It will be appreciated that the order of assembly for at least some of the components can differ from what is described.

Generally, the coating and the heating elements 88 are applied to the first glass panel 68 before assembly. The holes 80, 84 can be cut before or after the heating elements 88 are applied to the panel 68. With reference to FIGS. 3, 5, and 6, the glass panel assembly 42 and the electrical connector assembly 100 can be assembled by placing the inner insulation bushing 144 and the connector bushing 108 between the first and second glass panels 68, 72, and positioning the connector bushing 108 on the column 152 of the bushing 144. Initially, during assembly, the tab 132 is straight so that the tab 132 can extend through the hole 80 and the outer insulation bushing 160 without interference.

Next, the glass panels 68, 72 are positioned adjacent or in close proximity with each other. The connector 104 (with the gasket 124 in place under the head 112) is then inserted through the second hole 84, through the inner insulation bushing 144, through the first hole 80, and then through the hole 64 in the base 58 of the hinge assembly 40 so that it protrudes outward from surface 1 of the first glass panel 68. The outer insulation bushing 160 is then coupled to the elongated body 118 and the tab 132 is bent so that it protrudes into the pocket 172. The washer 164 and the cap 168 are then placed on the elongated body 118. The electrical connection between the power supply 90 and the connector bushing 108 can be made before or after the tab 132 is bent, as well as before or after the cap 168 is tightened onto the connector 104.

The cap 168 is tightened so that a) the gasket 124 is sandwiched and slightly compressed between the head 112 and the second glass panel 72 to partially seal the gap 76 by sealing the hole 84, b) the annular body 128 is engaged with and electrically coupled to the connector segment 94, and c) the connector assembly 100 is securely attached to the glass panel assembly 42 by pressing the outer insulation bushing 160 into the hole 64 and against the base 58. As assembled, the glass panel assembly 42 is sandwiched between the connector 104 and the outer insulation bushing 160. The outer periphery of the gap 76 can be sealed before or after the connector assembly 100 is completely assembled onto the glass panel assembly 42. With reference to FIGS. 3, 5, and 6, a hinge housing 180 can be removably attached or fixed to the hinge assembly 40 to enclose the components of the electrical connector assembly 100 that are exposed on the interior side of the glass panel 68. As illustrated, the housing 180 is shaped to conform to the curvature and size of the hinge body 52.

As illustrated, the connector assembly 100 makes electrical contact between the heating element 88 and the power supply 90 while also securing the hinge assembly 40 to the glass panel assembly 42. Depending on the construction of the glass panel assembly 42, the connector assembly 100 also can at least partially secure the glass panels 68, 72 in spaced relation relative to each other (e.g., the connector bushing 108 and the inner insulation bushing 144 can act as spacers between the panels 68, 72.

The connector assembly 100 provides a substantially hidden or obscured electrical path through the glass panel assembly 42 (that is, from within the gap 76) to an exterior of the glass panel assembly 42. More specifically, the connector bushing 108 provides an electrical path from the heating elements 88 in the gap 76 of the glass panel assembly 42 to the inner side of the glass panel assembly 42. In addition, the inner and outer insulation bushings 144, 160 electrically isolate the connector bushing 104 from the glass panel assembly 42 and the remainder of the connector assembly 100, including the exposed head 112 on the outer surface 4 of the second glass panel 72 and the cap 168 on the inner side of the glass panel assembly 42.

Figure 8:
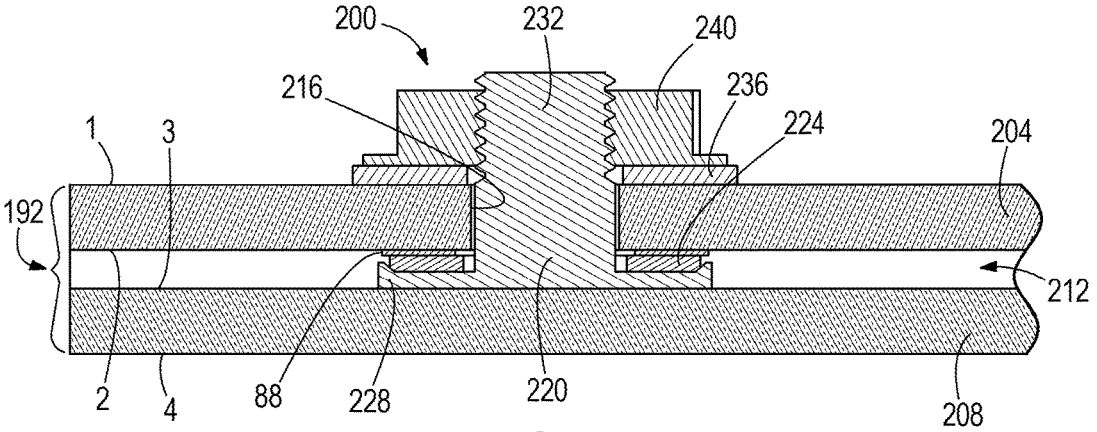
FIG. 8 is a cross-section of a portion of the door of FIG. 7.
Figure 7:
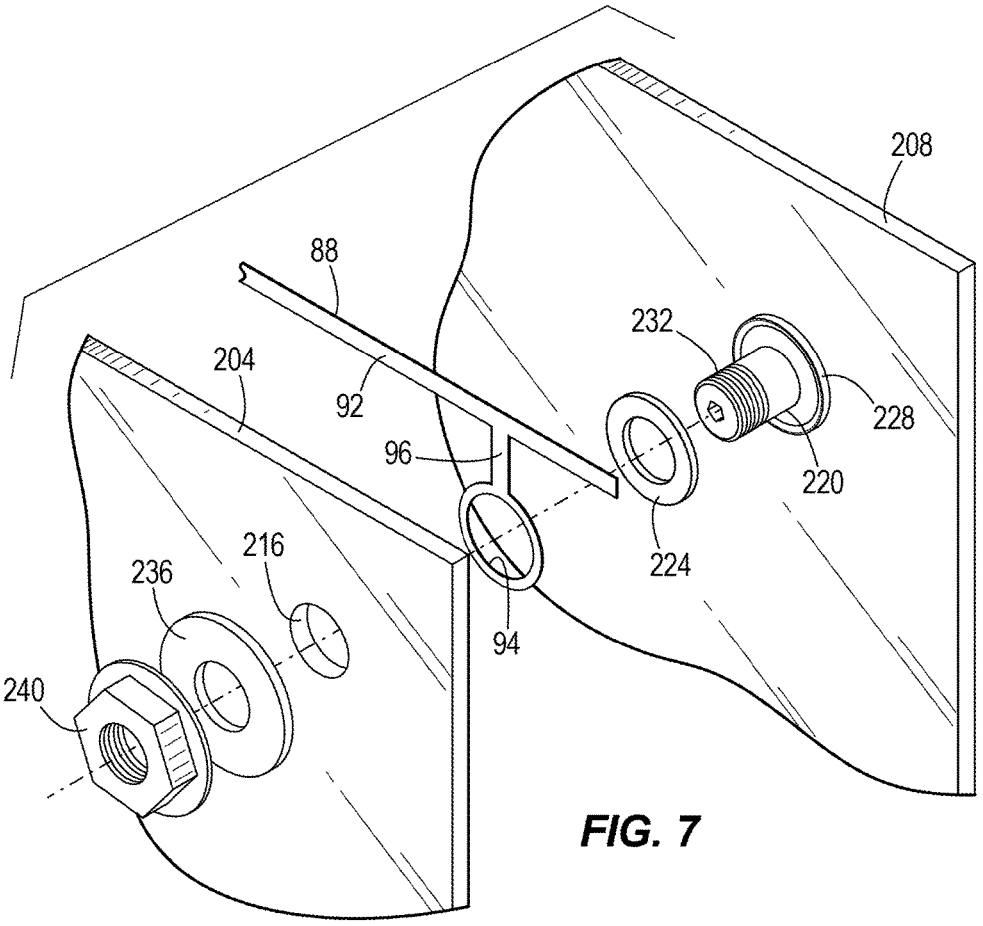
FIG. 7 is an exploded perspective view of another electrical connector assembly that can be used on a door similar to the door of FIG. 2.

FIGS. 7 and 8 illustrate another glass panel assembly 192 and another electrical connector assembly 200 that can be installed on the door 34 to provide an electrical path from the interior of the glass panel assembly 192 to an exterior of the glass panel assembly 192. Although not entirely illustrated, the remaining components of the door 34 (e.g., the hinges 40, the heater elements 88, etc.) are the same as described with regard to FIGS. 2-6 and, as such, will not be described again.

The glass panel assembly 192 defines a vacuum-sealed structure that includes a first glass panel 204 positioned closest to the product display area 22, and a second glass panel 208 that is spaced apart from the first glass panel 204 by a gap 212. The gap 212 can be vacuum sealed by appropriate manufacturing methods to limit infiltration of debris between the panels 204, 208, and to inhibit or limit heat transfer across or through the glass panels 204, 208 between the product display area 22 and the ambient environment. Although the glass panel assembly 192 is described in detail as having two glass panels 204, 208, the assembly 40 can include additional glass panels (e.g., positioned between the glass panels 204, 208, positioned further exterior of the glass panel 208 relative to the product display area 22, etc.).

FIGS. 7 and 8 show that the first glass panel 204 has a hole 216 (one shown), and the second glass panel 208 is provided without a hole. The hole 216 is located on the first glass panel 204 adjacent the hinge assembly 40 and is aligned with a corresponding hole 64 in the bases 58 when the door 34 is assembled. The illustrated first glass panel 204 has a transparent resistive or conductive coating that can heat the door 34 to inhibit formation of or remove fog and condensation on the glass panel assembly 192. The coating is applied to surface 2 of the panel 204—the surface of the panel 204 that faces away from the product display area 22. As will be appreciated, the conductive coating can be applied to surface 1 of the first glass panel 204. The coating may be a metallic pyrolytic coating, a magnetic sputter vacuum deposition coating, or another suitable coating that can apply heat to the first glass panel 204. A protective layer or film can be applied over the coating to protect the coating from direct contact. The second glass panel 208 can have a transparent coating (e.g., a low emissivity coating, a conductive coating, etc.), or the second glass panel 208 can be provided without a coating.

The heater elements 88 are electrically connected to the power supply 90 by the electrical connector assembly 200. With continued reference to FIGS. 7 and 8, the connector assembly 200 includes a connector 220 and a connector bushing 224 that is coupled to the connector 220. The illustrated connector 220 is a fastener (e.g., a bolt), although the connector 220 can take other forms. The connector 220 has a head 228 that is recessed on its underside, and a threaded elongated body 232 that extends through the holes 64, 216. The connector 220 is formed of an electrically-conductive material (e.g., a metal such as soft copper, steel, etc., or an alloy).

The illustrated connector bushing 224 takes the form of a washer that is formed of a conductive material (e.g., brass, copper, aluminum, etc.) and that can be compressed (e.g., at least partially crushed) in response to a vacuum being pulled on the glass panel assembly 192. Stated another way, the connector bushing 224 defines a crush seal that seals the hole 216 so that the vacuum is lost. Although the connector bushing 224 is illustrated as being separable from the connector 220, it will be appreciated that the connector bushing 224 can be formed with the connector 220 (i.e. the connector 220 and the bushing 224 can be co-formed together at the same time to produce a single piece). With reference to FIGS. 7 and 8, the connector bushing 224 is positioned between (e.g., sandwiched by) the underside of the head 228 and the heater element 88 so that electrical contact can be made with the heating element 88.

The connector assembly 200 also includes a washer 236, and a nut or cap 240. The washer 164 is coupled to the connector 220 and is held in place by the cap 240. The washer 236 and the cap 240 can be formed of electrically isolative or insulative material (e.g., plastic, composite, etc.), or of an electrically conductive material (e.g., metal, alloy, etc.). The electrical connection between the heating elements 88 and the power supply 90 can be made by connecting the wires (not shown) directly to the connector 220 (e.g., when the washer 236 and the cap 240 are electrically insulative), or the connection can be made cooperatively by tightening the cap 240 onto the connector 224 (e.g., sandwiching the connection between the washer 236 and the cap 240). The cap 240 is threadably attached to the elongated body 232 to secure the connector assembly 200 onto the glass panel assembly 192 when the cap 240 is tightened.

Assembly of the glass panel assembly 192 and the electrical connector assembly 200 can be done several ways, one of which is described below. It will be appreciated that the order of assembly for at least some of the components can differ from what is described.

Generally, the coating and the heating elements 88 are applied to the first glass panel 204 before assembly. The hole(s) 216 can be cut before or after the heating elements 88 are applied to the panel 204. With reference to FIGS. 3, 5, and 6, the glass panel assembly 192 and the electrical connector assembly 200 can be assembled by placing the connector 220 and the connector bushing 224 between the first and second glass panels 204, 208, and positioning the connector bushing 108 on the elongated body 232.

Next, the glass panels 204, 208 are positioned adjacent or in close proximity with each other and the vacuum seal is formed between the glass panels 204, 208. When a vacuum seal is made, the evacuation of the air from the gap 212 compresses or crushes the connector bushing 224 so that a tight seal is formed around the hole 216 on surface 2 of the panel 204. The crush-seal nature of the bushing 224 inhibits loss of the vacuum from the gap 212. After the vacuum seal is formed, the washer 236 and the cap 240 are attached to the connector 220 and the cap is tightened to secure the connector assembly 200 in place on the glass panel assembly 192. It will be appreciated that the washer 236 and the cap 240 can be loosely installed onto the connector 220 before the vacuum is pulled on the gap 212, and that the washer 236 and the cap 240 can be tightened afterward. In general, the electrical connection to the connector 220 is made before the cap 240 is tightened.

The cap 168 is tightened so that a rigid electrical connection is made between the heater element 88 and the connector 220, and so that the connector assembly 200 is securely attached to the glass panel assembly 192. As assembled, the first glass panel 204 is sandwiched between the connector 220 and the washer 236, and the connector 220 is further inaccessible from the exterior of the glass panel assembly 192 (relative to the product display area 22). The hinge housing 180 can be removably attached or fixed to the hinge assembly 40 to enclose the components of the electrical connector assembly 200 that are exposed on the interior side of the glass panel 204.

As illustrated, the connector assembly 200 makes electrical contact between the heating element 88 and the power supply 90 while also securing the hinge assembly 40 to the glass panel assembly 192. The connector assembly 200 provides a substantially hidden or obscured electrical path through the glass panel 204 (i.e. from within the gap 76 to an exterior of the glass panel assembly 42. In addition, the second glass panel 208 isolates the electrically-conductive connector 220 from contact on the outside of the door 34.

Various features and advantages of the invention are set forth in the following claims.

The invention claimed is:

1. A door for a refrigerated merchandiser including a case defining a product display area, the door comprising:

a door frame attachable to the case;

a glass panel assembly coupled to the door frame and including a first glass panel and a second glass panel spaced apart from the first glass panel by a gap, the glass panel assembly further including a conductive coating applied to the first glass panel and a heater element coupled to the first glass panel and in electrical communication with the conductive coating; and a connector extending through the first glass panel and the second glass panel and securable to the glass panel assembly, wherein the connector is configured to electrically connect the heater element to a power source.

2. The door of claim 1, wherein the connector includes a bolt and a cap, and wherein the electrical connection between the heater element and the power source is made by tightening the cap on the bolt.

3. The door of claim 2, further comprising an electrical connector bushing electrically coupled to the heater element and an insulation bushing disposed between the electrical connector bushing and the connector to electrically isolate from the connector from the electrical connector bushing.

4. The door of claim 1, further comprising an electrical connector bushing coupled to the connector and in direct communication with the heater element, wherein the electrical connector bushing extends from within the gap through the first glass panel.

5. The door of claim 4, further comprising an insulation bushing at least partially enclosing an end of the electrical connector bushing exposed through the first glass panel.

6. The door of claim 1, further comprising a hinge coupled to the door frame to facilitate pivotal movement of the door between a closed position and an open position, wherein the hinge is at least partially coupled to the first glass panel by the connector.

7. The door of claim 6, wherein the hinge includes a base that supports a hinge pin and a hinge housing that encloses a portion of the connector.

8. The door of claim 1, further comprising a first insulation bushing coupled to the connector and at least partially disposed in the gap, and a second insulation bushing coupled to the connector, wherein the first and second insulation bushings are positioned to cooperatively seal the gap.

9. A door for a refrigerated merchandiser including a case defining a product display area, the door comprising:

a door frame attachable to the case;

a glass panel assembly coupled to the door frame and including a first glass panel and a second glass panel spaced apart from the first glass panel by a gap, the glass panel assembly further including a conductive coating applied to the first glass panel and a heater element coupled to the first glass panel and in electrical communication with the conductive coating; and a connector extending through the first glass panel and securable to the glass panel assembly; and a connector bushing coupled to the connector and positioned between the connector and the heater element, wherein the connector bushing defines a seal configured to at least partially compress in response to a vacuum applied to the gap to seal the gap.

10. The door of claim 9, wherein the connector bushing is configured to electrically connect the connector to the heater element.

11. The door of claim 9, wherein the connector is encapsulated by the second glass panel and the connector is coupled to a power source adjacent an end of the connector exposed through the first glass panel, and wherein the connector is electrically coupled to the heater element via the connector bushing.

12. The door of claim 9, wherein the connector includes a bolt and a cap, and wherein the electrical connection between the heater element and the power source is made by tightening the cap on the bolt.

13. The door of claim 12, wherein the connector bushing is disposed entirely within the gap.

14. The door of claim 9, further comprising a hinge coupled to the door frame to facilitate pivotal movement of the door between a closed position and an open position, wherein the hinge is at least partially coupled to the first glass panel by the connector.

15. A door for a refrigerated merchandiser including a case defining a product display area, the door comprising:

a glass panel assembly including a first glass panel and a second glass panel spaced apart from the first glass panel by a gap, the glass panel assembly further including a conductive coating applied to the first glass panel and a heater element coupled to the first glass panel and in electrical communication with the conductive coating; and a connector extending through the first glass panel and securable to the glass panel assembly to electrically connect the heater element to a power source; and a hinge attached to the glass panel assembly by the connector to facilitate movement of the door between an open position and a closed position.

16. The door of claim 15, wherein the connector includes a fastener and a cap, and wherein tightening the cap on the fastener secures the hinge to the glass panel assembly and electrically engages the fastener with the heater element.

17. The door of claim 16, further comprising a seal positioned between the fastener and the heater element, wherein the seal is compressible in response to tightening of the cap.

18. The door of claim 15, wherein the connector extends through the first glass panel and the second glass panel.

19. The door of claim 15, further comprising an electrical connector bushing positioned between the connector and the heater element, and wherein the connector bushing is at least partially disposed within the gap.

* * * * *